US009327955B2

(12) United States Patent
Simpson

(10) Patent No.: US 9,327,955 B2
(45) Date of Patent: May 3, 2016

(54) FUNNEL FOR FACILITATING EMPTYING OF A LIQUID-FILLED CONTAINER

(71) Applicant: RYKO SOLUTIONS, INC., Grimes, IA (US)

(72) Inventor: David Simpson, Clive, IA (US)

(73) Assignee: RYKO SOLUTIONS, INC., Grimes, IA (US)

( * ) Notice: Subject to any disclaimer, the term of this patent is extended or adjusted under 35 U.S.C. 154(b) by 230 days.

(21) Appl. No.: 14/229,953

(22) Filed: Mar. 30, 2014

(65) Prior Publication Data

US 2015/0274499 A1 Oct. 1, 2015

(51) Int. Cl.

| | |
|---|---|
| ***B67C 11/02*** | (2006.01) |
| ***B67B 7/86*** | (2006.01) |
| ***B67C 9/00*** | (2006.01) |
| *B67C 11/00* | (2006.01) |

(52) U.S. Cl.
CPC . *B67C 11/02* (2013.01); *B67B 7/28* (2013.01); *B67C 9/00* (2013.01); *B67C 2011/30* (2013.01)

(58) Field of Classification Search
CPC ..... B67B 7/28; B67C 9/00; B67C 11/00; B67C 11/02
USPC ..... 141/319, 321, 329, 331–345
See application file for complete search history.

(56) References Cited

U.S. PATENT DOCUMENTS

| | | | | | |
|---|---|---|---|---|---|
| 200,149 | A * | 2/1878 | Newman | A61M 5/1782 | 141/328 |
| 5,123,461 | A * | 6/1992 | Belokin, Jr. | B65D 17/163 | 141/322 |
| 5,385,180 | A * | 1/1995 | Wittman | B67C 11/02 | 141/106 |
| 5,884,502 | A * | 3/1999 | Jones | F25C 5/16 | 141/331 |
| 6,644,366 | B2 * | 11/2003 | Johnson | F41B 11/50 | 124/72 |
| 6,715,647 | B1 * | 4/2004 | Ivins | B44D 3/126 | 141/319 |
| 6,845,794 | B2 * | 1/2005 | Johnson | F41B 11/50 | 124/72 |
| 6,863,099 | B2 * | 3/2005 | Watkins | B67C 11/04 | 141/340 |
| 6,962,174 | B1 * | 11/2005 | Trantham | B08B 9/08 | 141/106 |
| 7,677,276 | B2 * | 3/2010 | Sun | B67C 11/02 | 141/332 |
| 9,010,388 | B2 * | 4/2015 | Sanchez | B65B 39/007 | 141/331 |
| 2003/0159756 | A1 * | 8/2003 | Johnson | F41B 11/50 | 141/331 |
| 2004/0140014 | A1 * | 7/2004 | Johnson | F41B 11/50 | 141/98 |
| 2005/0133110 | A1 * | 6/2005 | Dossett | B67C 11/02 | 141/18 |

OTHER PUBLICATIONS

"Lustra Professional Car Care Products—Ultraflex® Professional Car Care Products". Accessed Aug. 22, 2014. http://www.lustrabear.com/car_wash_programs/car_wash_ultraflex_v4.asp?ufvideo=yes.

CK Enterprises, Inc. "S.C.U.B.A. Car Wash Detergent Delivery System". Accessed Aug. 22, 2014. http://ckcarcare.com/home/car-wash-detergent-dispensers/scuba/.

* cited by examiner

*Primary Examiner* — Nicolas A Arnett

(57) ABSTRACT

A funnel for facilitating emptying of a liquid-filled container includes a receptacle. The receptacle is configured to support the liquid-filled container in a declined position with an opening of the container at or near a lowermost point of the container. The receptacle has an outlet for liquid. The funnel also includes a container shelf, adjacent to the receptacle, configured to support the liquid-filled container in an inclined position in which the container is inclined towards the receptacle. A tipping edge between the receptacle and a top of the container shelf is adapted to act as a fulcrum for tipping the container from the inclined position to the declined position. The receptacle may be formed within an insert that is removable from a base section of the funnel. A piercing element for piercing a protective seal on the opening may protrude inwardly into the receptacle on an angle.

26 Claims, 12 Drawing Sheets

FUNNEL FOR FACILITATING EMPTYING OF A LIQUID-FILLED CONTAINER

FIELD OF TECHNOLOGY

The present disclosure relates to a funnel, and more particularly to a funnel for facilitating emptying of a liquid-filled container.

BACKGROUND

In the vehicle wash industry, various types of liquids are used during the vehicle wash process, such as detergents, waxes, surface sealants, tire shining fluids, and others. These liquids may be unsuitable for contact with human skin for health reasons or may contain dyes that can stain human skin or clothing. A human operator may be required to wear special safety equipment, such as gloves and face protection, to handle certain liquids, e.g. for compliance with state or federal regulations.

Fluids of the type mentioned above may be sold in standardized containers. One common form of container sold in North America is the so-called F-style container. An F-style container or jug generally has a rectangular cuboid body with a top mounted handle and an offset pour spout: F-style containers are commonly made from plastic. An example of an F-style container is shown in U.S. Pat. No. Des. 274,130, which is hereby incorporated by reference. An example of a commercially available F-style container is the 2.5 gallon "Reike" bottle sold by Plastipak Packaging Inc.

Depending upon the nature of the liquid contained in an F-style container, the opening (e.g. pour spout) of the container may be sealed with a protective seal, which may be referred to as a "safety seal" or simply as a "seal". The protective seal, which may be made from foil or a film for example, may be intended prevent tampering with the liquid contents before use or to limit leakage or evaporation. The seal is removed before liquid is poured from the container.

Car-wash operators may consider the handling of containers containing fluids of the type mentioned above—whether F-style containers or other forms of containers—to be undesirable, e.g. due to the need to remove protective seals (if present), due to the possible need for special safety equipment as mentioned above, and because lifting the liquid-filled containers in preparation for, and during, pouring may be physically demanding.

Outside the car wash industry, other liquids may be sold in containers such as F-style containers and may also be considered dangerous or tedious to handle for similar reasons. These may include, but are not limited to, agricultural products such as insecticide, herbicide, or fertilizer, automotive products such as windshield washer fluid or antifreeze, or household products such as bleach, varnish, paint thinner, or other solvents.

SUMMARY

In one aspect of the present disclosure, there is provided a funnel for facilitating emptying of a liquid-filled container, the funnel comprising: a receptacle configured to support the liquid-filled container in a declined position with an opening of the container at or near a lowermost point of the container, the receptacle having an outlet for liquid; a container shelf adjacent to the receptacle, the container shelf configured to support the liquid-filled container in an inclined position in which the container is inclined towards the receptacle; and a tipping edge between the receptacle and a top of the container shelf, the tipping edge adapted to act as a fulcrum for tipping the container from the inclined position to the declined position.

In another aspect of the present disclosure, there is provided a funnel for facilitating emptying of a liquid-filled container into a tank, the funnel comprising: a receptacle configured to support the liquid-filled container in a declined position with an opening of the container at or near a lowermost point of the container, the receptacle having an outlet for liquid; a container shelf adjacent to the receptacle, the container shelf configured to support the liquid-filled container in an inclined position in which the container is inclined towards the receptacle; a tipping edge between the receptacle and a top of the container shelf, the tipping edge adapted to act as a fulcrum for tipping the container from the inclined position to the declined position; a spout in fluid communication with the outlet of the receptacle, the spout for discharging the liquid from the funnel, the spout being adapted to engage a tank opening of the tank; and a base configured for placement on a surface of the tank, wherein the configuration of base for placement on the surface of the tank and the adaptation of the spout for engagement of the tank opening collectively stabilize the funnel during use regardless of whether the liquid-filled container is in the inclined position on the container shelf or in the declined position within the receptacle.

In another aspect of the present disclosure, there is provided a funnel for facilitating emptying of a liquid-filled container, the funnel comprising: an insert comprising: a receptacle configured to support the liquid-filled container in a declined position with an opening of the container at or near a lowermost point of the container, the receptacle having an outlet for liquid; a base section comprising: a cavity for removably receiving the insert; a spout at the bottom of the cavity; and a container shelf adjacent to the cavity, the container shelf configured to support the liquid-filled container in an inclined position in which the container is inclined towards the cavity, wherein, when the insert is received within the cavity: the outlet of the receptacle is in fluid communication with the spout; and either one or both of the insert and the base section define a tipping edge between the top of the container shelf and the receptacle, the tipping edge adapted to act as a fulcrum for tipping the container from the inclined position to the declined position.

DETAILED DESCRIPTION

Figure 1:
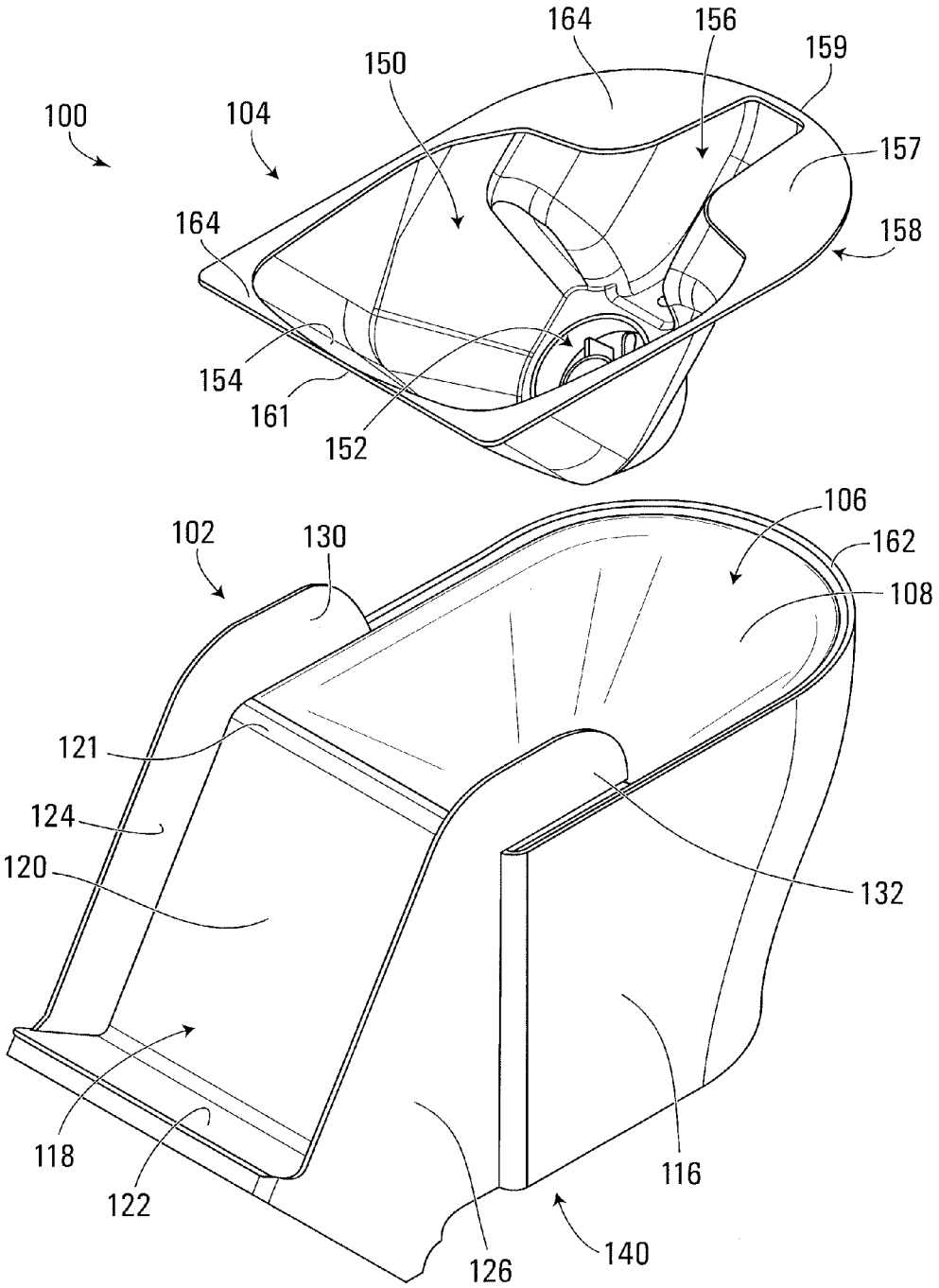
FIG. 1 is a perspective view of an example funnel in a disassembled state with an insert component separated from a base section component.
Figure 2:
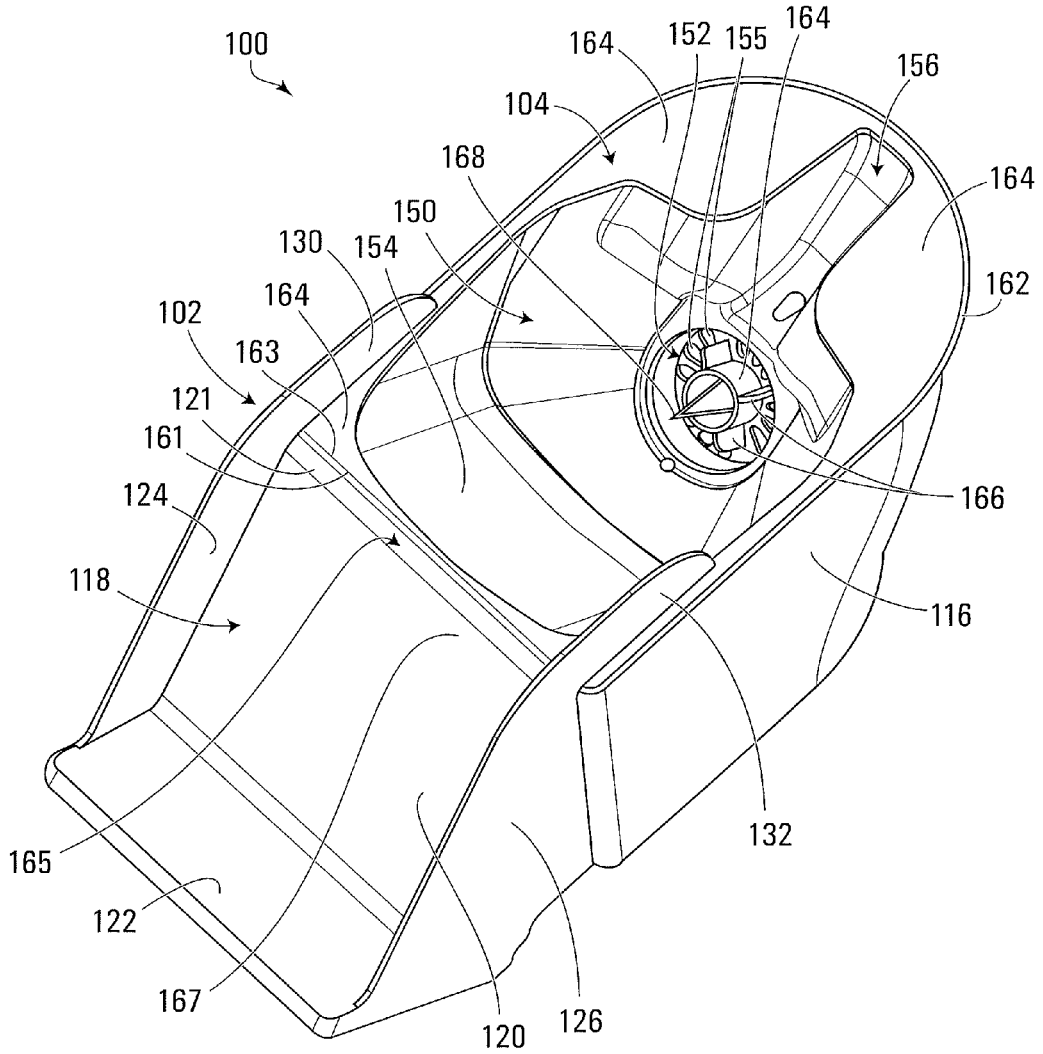
FIG. 2 is a perspective view of the funnel of FIG. 1 in an assembled state with the insert mated with the base section.
Figure 5:
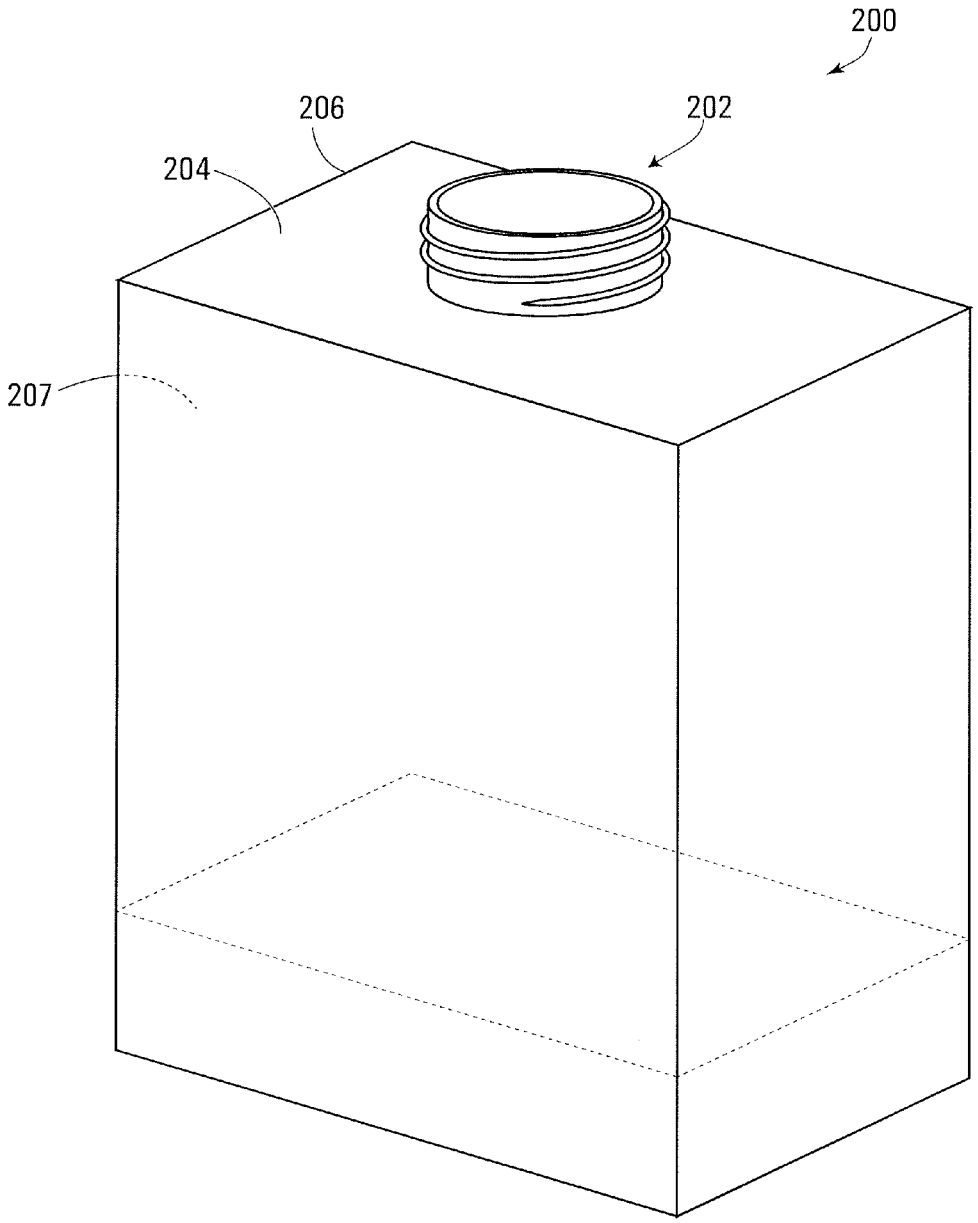
FIG. 5 is a perspective view of a tank that the funnel of FIG. 1 can be used to fill.

Referring to FIGS. 1 and 2, an example funnel 100 is illustrated in perspective view. The funnel 100 used to facilitate emptying of a liquid filled container. In this example, the container is an F-style container, and the funnel 100 is particularly adapted for emptying the container into a liquid storage tank 200 as shown in FIG. 5 for example. However, alternative embodiments may be used to empty other liquid-filled containers into other tanks or reservoirs.

For clarity, in this description a container is considered to be "liquid-filled" even when the level of liquid is below the top of the container, i.e. even when there is an air pocket at the top of the container.

The example funnel 100 of FIGS. 1 and 2 is a two-piece unit comprising a base section 102 and an insert 104. In the illustrated embodiment, the base section 102 supports the funnel as a free-standing unit during use, and the insert 104 adapts the funnel for use with a particular form factor of container, which in this example is an F-style container having a 2.5 gallon capacity. The two-piece design allows the insert 104 to be removed from the base section 102, e.g. for cleaning purposes or for substitution of a different insert (not illustrated) into the base section, e.g. adapting the funnel for use with a different type or form factor of liquid-filled container. The removability, of the insert 104 may thus allow the base section 102 to be used for emptying many types of containers.

FIG. 1 shows the funnel 100 in a disassembled state with the insert 104 being separated from (raised above) the base section 102. In contrast, FIG. 2 shows the funnel 100 in an assembled state, with the insert 104 mated with (dropped into) the base section 102. It is in the latter state that the funnel 100 is typically used. Both components of the funnel 100 may be made from a rigid material such as plastic.

Figure 3:
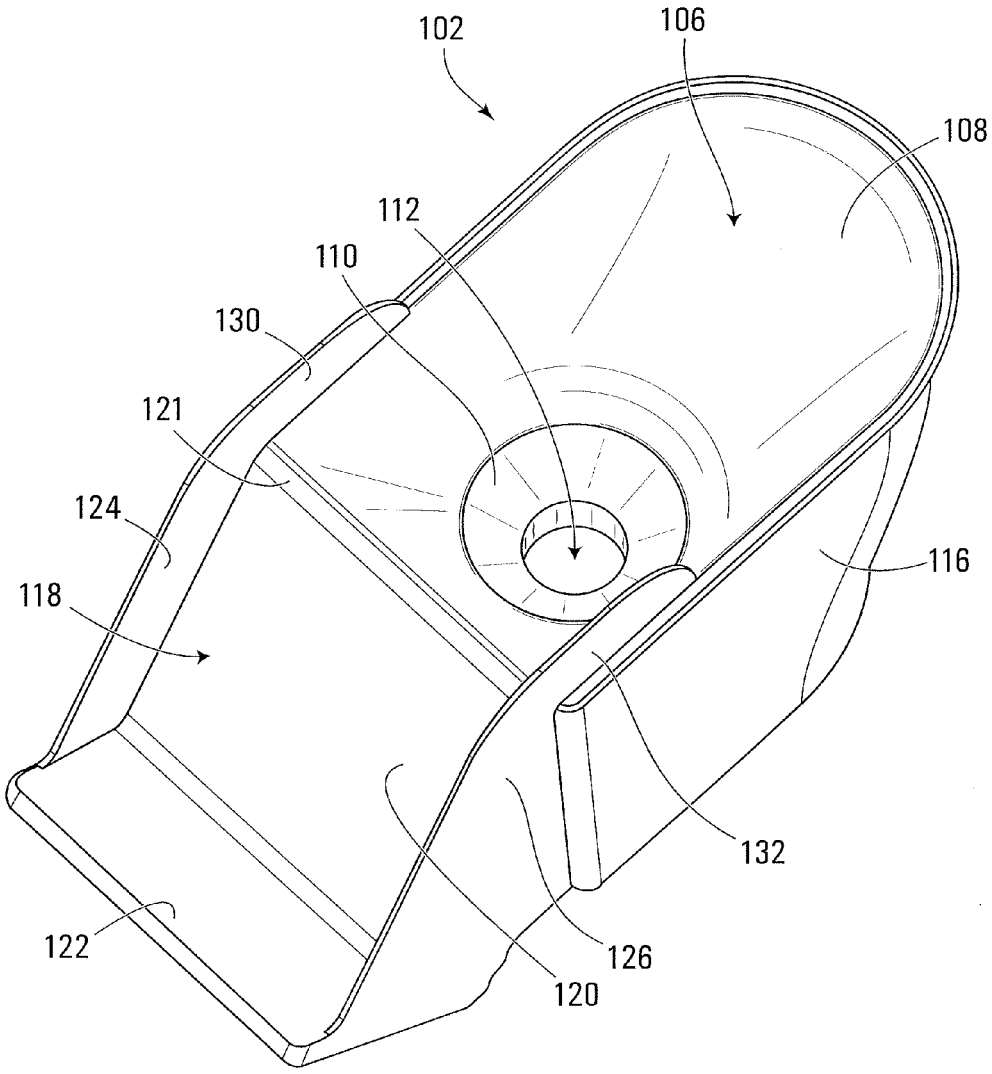
FIG. 3 is a perspective view of the base section of FIG. 1 from above.
Figure 4:
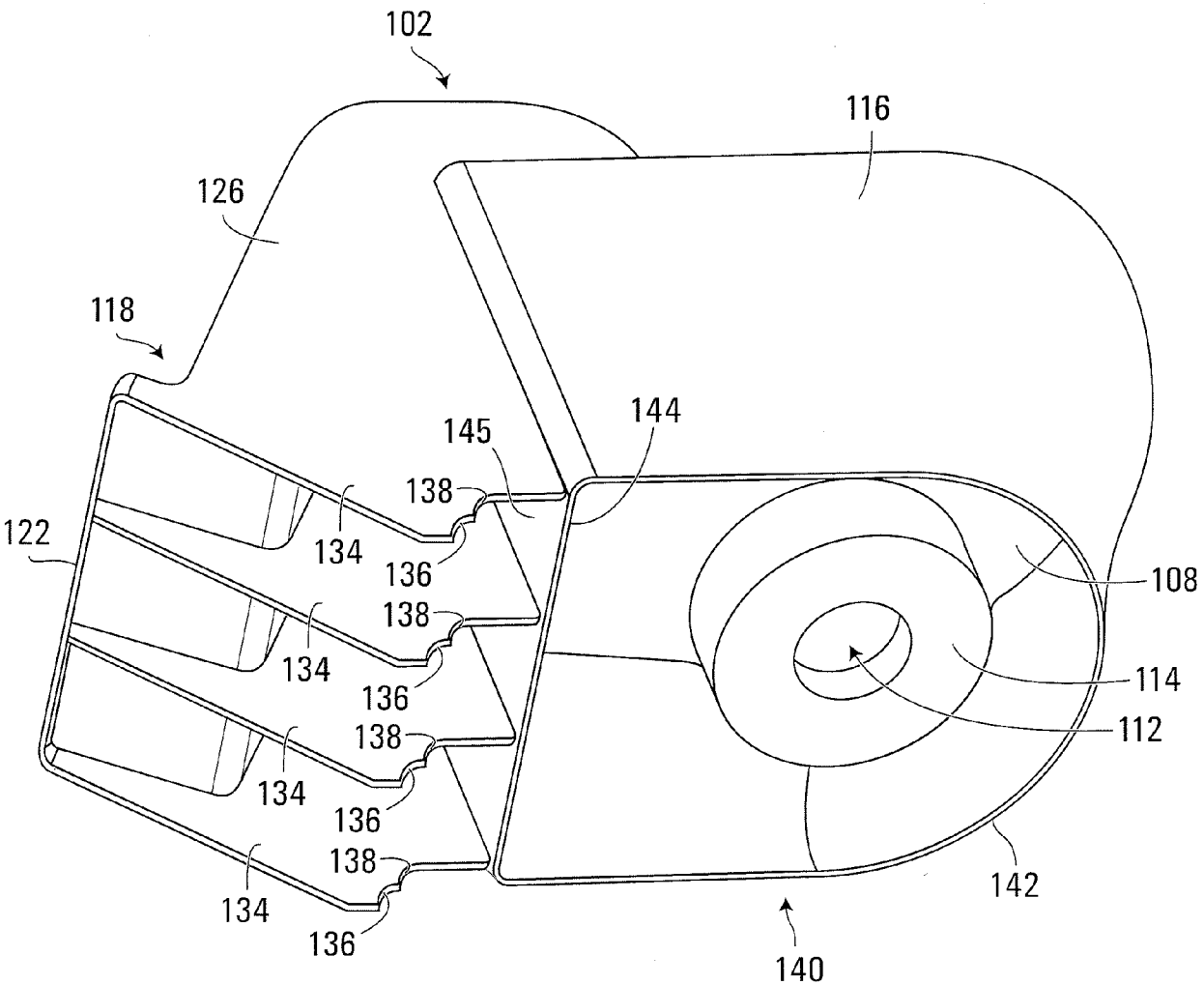
FIG. 4 is a perspective view of the base section of FIG. 1 from below.

FIGS. 3 and 4 are perspective views showing only the base section 102 from above and below respectively. Referring to FIG. 3, it can be seen that the base section 102 has a cavity 106 for removably receiving the insert 104 (i.e. for receiving the insert 104 in such a way that the insert 104 is removable from the base section 102). In the illustrated embodiment, the cavity 106 is generally oblong and is defined by an inwardly sloping inner wall 108. The cavity 106 of the present embodiment has a shallow conical bottom 110 with a central outlet 112 for liquid. The bottom 110 and outlet 112 are formed within a neck 114 that protrudes downwardly from the underside of the cavity 106, as best seen in FIG. 4. In view of the opening 112, the neck 114 may be considered as a form of spout for outflow of liquid from the funnel 100. As such, the neck 114 may be considered as a spout 114. The cavity may have other shapes in other embodiments.

The outer diameter of the neck 114 may be sized to fit inside an opening 202 of the liquid storage tank 200 onto which the funnel 100 is designed to be placed during use (see FIG. 5). The opening may be a threaded opening 202 as illustrated in FIG. 5. The protruding neck 114 may be received within, and may engage, the tank opening 202 when the funnel 100 is seated atop the tank 200. Such engagement may contribute to the stability of the funnel 100 during liquid emptying in the sense that tipping or lateral movement of the funnel 100 with respect to the tank 200 may be discouraged.

The diameter of the outlet 112 may be sized for snugly receiving a removable tube that may act as a fill tube for the tank 200 (described in more detail below). Not all embodiments of the funnel necessarily have or use a removable fill tube.

As shown in FIGS. 1-4, the base section 102 has an external wall 116 that is generally U-shaped and tapers downwardly at one end of the base section 102. The shape of the wall 116 may vary in other embodiments. In some embodiments, one or more portions of the wall 116 could be omitted, possibly exposing the exterior of the inwardly sloping inner wall 108. For example, the wall 116 at the rounded end of the funnel could be omitted.

The base section 102 also has, integrally formed therewith, a container shelf 118. The container shelf 118 is configured to support a liquid-filled container in preparation for emptying. The container shelf 118 supports the container in an inclined position, in which the container leans towards a receptacle of the funnel into which the liquid-filled container will be tipped for emptying. The container shelf 118 of the present embodiment includes an inclined wall 120, a foot 122 projecting from the bottom of the inclined wall 120, and a pair of guides 124, 126 flanking the inclined wall 120. the guides 124, 126 may be referred to as shelf guides. In the present embodiment, the foot 122 and the inclined wall 120 collectively support the liquid-filled container during use, with the container resting on the foot 122 and leaning against the wall 120. The wall 120 is inclined at an angle of approximately 30 degrees from vertical in the present embodiment. This angle may vary between embodiments. An upper edge 121 of the wall 120 is rounded in the present embodiment.

The foot 122 of the container shelf 118 protrudes substantially orthogonally from the bottom the inclined wall 120. The shelf guides 124, 126 on either side of the wall 120 may facilitate centering of the liquid-filled container on the shelf 118 and may help to keep the container from falling off the shelf 118 once placed thereupon. In the present embodiment, the upper ends of guides 124, 126 extend to form horizontal guide extensions 130, 132 respectively that at least partially flank the cavity 106. These guide extensions 130, 132, which may be referred to as tipping guides 130, 132, may help to keep the liquid-filled container laterally centered with respect to the cavity 106 during container tipping and emptying.

Referring to FIG. 4, it can be seen that the container shelf 118 comprises a plurality of ribs 134 (four in this example) that are visible from below the base section 102. Two of the ribs 134 act as walls in this embodiment. The ribs 134 contribute to the structural integrity and strength of the inclined wall 120 and foot 122 that collectively form the container shelf 118. A lower portion of each rib 134 is notched with notches 136, 138. The notched areas of the ribs 134 form part of a base 140 for the funnel 100, described below.

Still referring to FIG. 4, the base section 102 of the funnel includes a base 140 adapted to support the funnel 100 as a stable, free-standing unit during use. In the illustrated embodiment, the base 140 is defined by a lower edge 142 of the external wall 116, a lower edge 144 of a wall 145 between the cavity 106 and the container shelf 118, and the notched sections 136, 138 of the plurality of ribs 134 mentioned above. The base 140 supports the weight of the funnel 100 together with the weight of a liquid-filled container that has been placed onto the funnel 100 during use.

The shape of the base 140 may vary between embodiments depending upon the surface or container onto which the funnel 100 is intended to be placed during use. In the present example, the base 140 is mostly flat in view of the fact that the upper surface 204 of the tank 200 (see FIG. 5) onto which the funnel 100 is intended to be placed is flat. An exception is the notches 136, 138, which are not flat because they are not intended to sit atop the upper surface 204 of the tank 200 during use. Rather, the notches are intended accommodate or conform to a feature of the tank, namely the top edge 206 of the tank 200 (see FIG. 5) between the surface 204 and the tank wall 207. As will be appreciated, the notches may help to stabilize the funnel 100 during use. The notches may also be designed to help position the neck 114 over the tank opening 202. In particular, each set of notches 136, 138 may be separated from the neck 114 by a predetermined distance, so that the neck 114 aligns with the tank opening 202 when the top edge 206 of the tank 200 is accommodated within one of the sets of notches 136, 138.

The reason that each rib has two notches 136, 138 in the present embodiment is to allow the funnel 100 to be used with two different size tanks. When the funnel 100 is placed on a larger tank (e.g. 20 gallon), the top edge 206 of the tank may be received in the lower notch 136 of each of ribs 134 for alignment of the neck 114 with the tank opening 202. When the funnel 100 is placed on a smaller tank (e.g. 7 gallon), the top edge 206 may be received in the upper notch 138 of each of ribs 134 for alignment of the neck 114 with the tank opening 202. In other words, the placement of the notches 136, 138 may be such that, regardless of whether the funnel 100 is being used with the larger or smaller tank size, the neck 114 of the funnel 100 will be properly positioned so as to be received within the tank opening 202, provided that the tank edge 206 is accommodated or seated within the respective notches 136 or 138 for the tank in question. The neck 114 may also be tapered to facilitate insertion or seating within, and/or engagement with, different sizes of tank openings.

Referring back to FIGS. 1 and 2, the insert 104 component of the funnel 100 comprises a receptacle 150 having an open top and an outlet 152 for liquid near the bottom. The receptacle 150 is configured to support the liquid-filled container in a declined position with an opening of the container at or near a lowermost point of the container. This is to promote complete or nearly complete emptying of the container of liquid. The receptacle 150 of the present embodiment has a sloped wall 154 that supports much of the weight of the liquid-filled container to be emptied. The sloped wall 154 is inclined at an angle of approximately 45 degrees from vertical in the present embodiment. Put another way, the liquid-filled container to be emptied is angled downwardly (declined) by approximately 45 degrees when it is seated within the receptacle 150 of this embodiment. This angle may vary between embodiments.

The receptacle 150 is generally configured (e.g. shaped and sized) to complement or conform to the external profile of an F-style container in the declined position. For example, the receptacle has a channel that acts as a handle guide 156 for receiving the handle of an F-style container. The configuration (e.g. shape and size) of the receptacle 150, including the handle guide 156, may help to position the container upon tipping and steady the container within the receptacle 150 as the container empties. The configuration of the receptacle 150 may differ between embodiments, depending upon the type or form factor of the liquid-filled containers with which the funnel is intended to be used.

In the present embodiment, the outlet 152 at the bottom of the receptacle 150 comprises a circular recess with multiple holes 155 for liquid which may collectively act as a filter (see FIG. 2). In the present example, the recess is sized to accommodate the opening or spout portion of an F-style container to be emptied. The outlet 152 has various features for automatically piercing and opening a protective seal (to the extent that one is present) upon seating of the container within the receptacle 150. These features include a ring 164, multiple fins 166 radiating from the ring (four fins in this example), and a piercing element 168 protruding into the receptacle 150 from the ring 164. The piercing element may have a tapered awl or blade shape and may be attached to the inside of the ring 164 for stability. The angle of incline at which the piercing element protrudes inwardly into the receptacle may match an angle of decline of the liquid-filled container 300 when received within the receptacle 150 (here, 45 degrees). The purpose and function of these features is described below. When the funnel 100 is used to empty a liquid-filled container whose opening lacks a seal, these features may go unused.

Referring to FIG. 1, the insert 104 has a flat peripheral lip 157 whose perimeter defines a truncated obround shape with a curved edge 159 and an opposing straight edge 161. The lip 157 fits within a complementary truncated obround depression formed between a curved upstanding ridge 162 at a periphery of the rounded portion of base section 102 (see FIG. 1) and the upper edge 121 of the inclined wall 120.

When the insert 104 is mated with the base section 102 (as in FIG. 2), the upper surface 164 of the insert 104 becomes flush with the upper surface of the curved ridge 162 and the upper edge 121 of the inclined wall 120 of the base section 102. In the assembled funnel 100, the receptacle 150 is adjacent to the container shelf 118. The upper surface 164 may be slightly inwardly sloped (e.g. by approximately 1 degree) towards the receptacle 150 to encourage any spilled liquid to drain into the receptacle 150.

Along the straight edge 161 of the insert 104, the upper surface 164 of the insert and the rounded upper edge 121 of the inclined wall 120 collectively form a tipping edge 165 between the top 167 of the container shelf 118 and the receptacle 150. The tipping edge 165 is intended to act as a fulcrum for tipping the liquid-filled container from the inclined position (seated on the container shelf 118) to the declined position (declined, although not necessarily fully seated, within the receptacle 150). It will be appreciated that, in the present embodiment, the tipping edge 165 that is formed is blunt, i.e. does not define a sharp edge. This is in view of the curvature of the upper edge 121 of the container shelf 118, the flatness of the portion of the lip 157 between the top edge of the container 118 shelf and the receptacle 150, and the presence of a small gap 163 between the container shelf 118 and the insert 104 (e.g. given that the insert 104 is a separate component from base section 102). The tipping edges of other embodiments may lack one or more of these features and may or may not be similarly blunt. Moreover, the tipping edges of other embodiments could be defined entirely by the base section or entirely by the insert.

Use of the funnel 100 for emptying of a liquid-filled container into a tank is illustrated in FIGS. 6-12.

Figure 6:
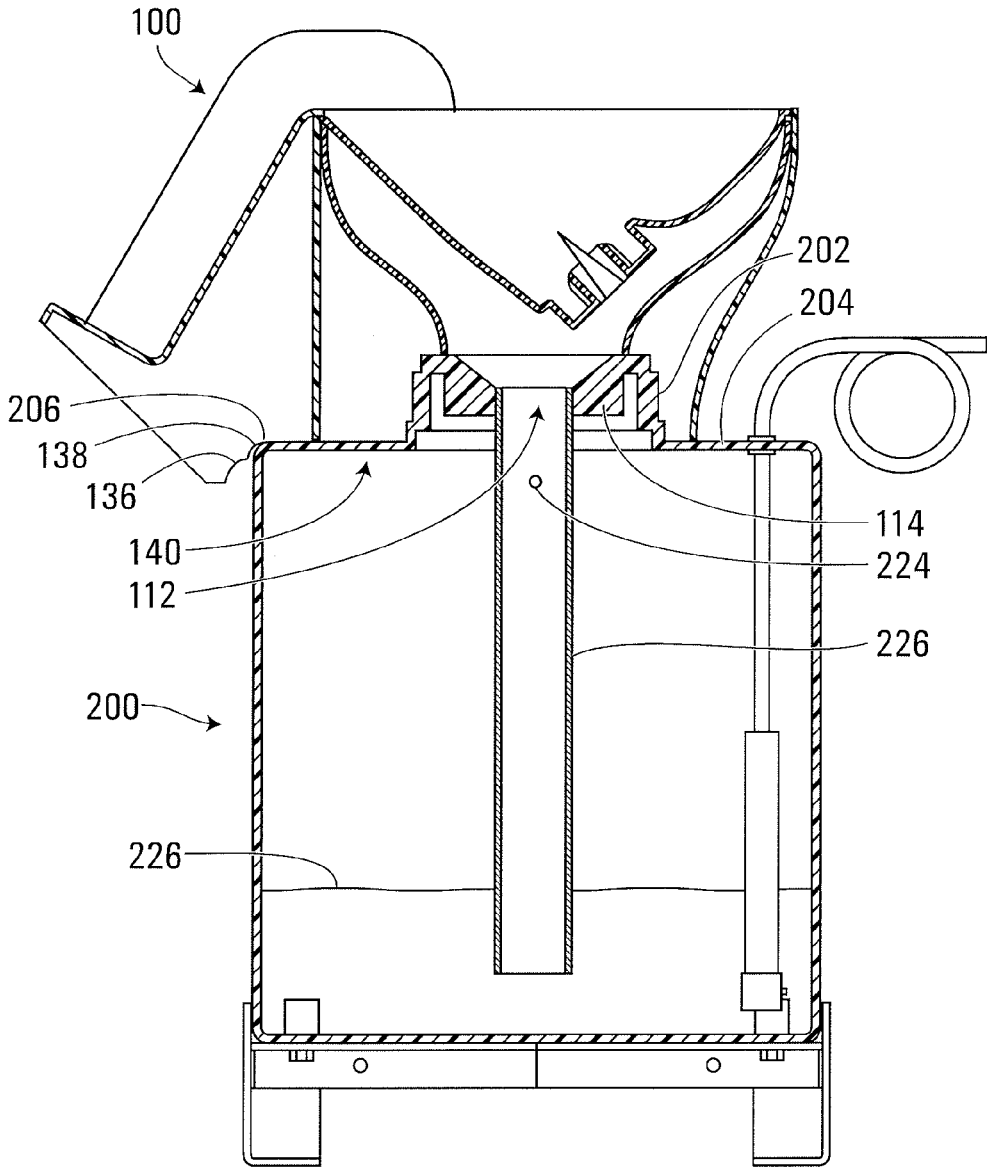
FIG. 6 is a cross-sectional view of the funnel of FIG. 1 seated atop the tank of FIG. 5 in preparation for use.

Referring to FIG. 6, a cross-sectional view of the funnel 100 seated atop tank 200 is shown. The funnel 100, in an assembled state (as in FIG. 2) and with a fill tube 222 having been inserted into funnel outlet 112, sits atop tank 200. The flat portions of the funnel base 140 sit on the flat surface 204 of the tank 200. The neck 114 is within the tank opening 202. Although perhaps not apparent from FIG. 6, the neck 114 may be engaged with (e.g. in contact with or seated within) the tank opening 202. The notches 138 in ribs 134 accommodate the edge 206 of the tank. The combined effect of the engagement of neck 114 within tank opening 202 and the accommodation of top edge 206 of the tank 200 within the notches 138 may stabilize the funnel 100 during use regardless of whether a liquid-filled container is in the inclined position on the container shelf 118 or in the declined position within the receptacle 150. The neck 114 of the funnel is positioned within the tank opening 202, so that the fill tube 222 that extends downwardly from the funnel outlet 112 and almost reaches the bottom of the tank 200. This may help to limit foaming of liquid inside the tank 200, e.g. by allowing the downwardly flowing liquid to cascade along an interior wall of the fill tube 222 and below a surface level of liquid 226 within the tank 200. A vent 224 in the fill tube may permit air from above the surface level 226 of liquid in the tank to vent as the tank fills.

Figure 7:
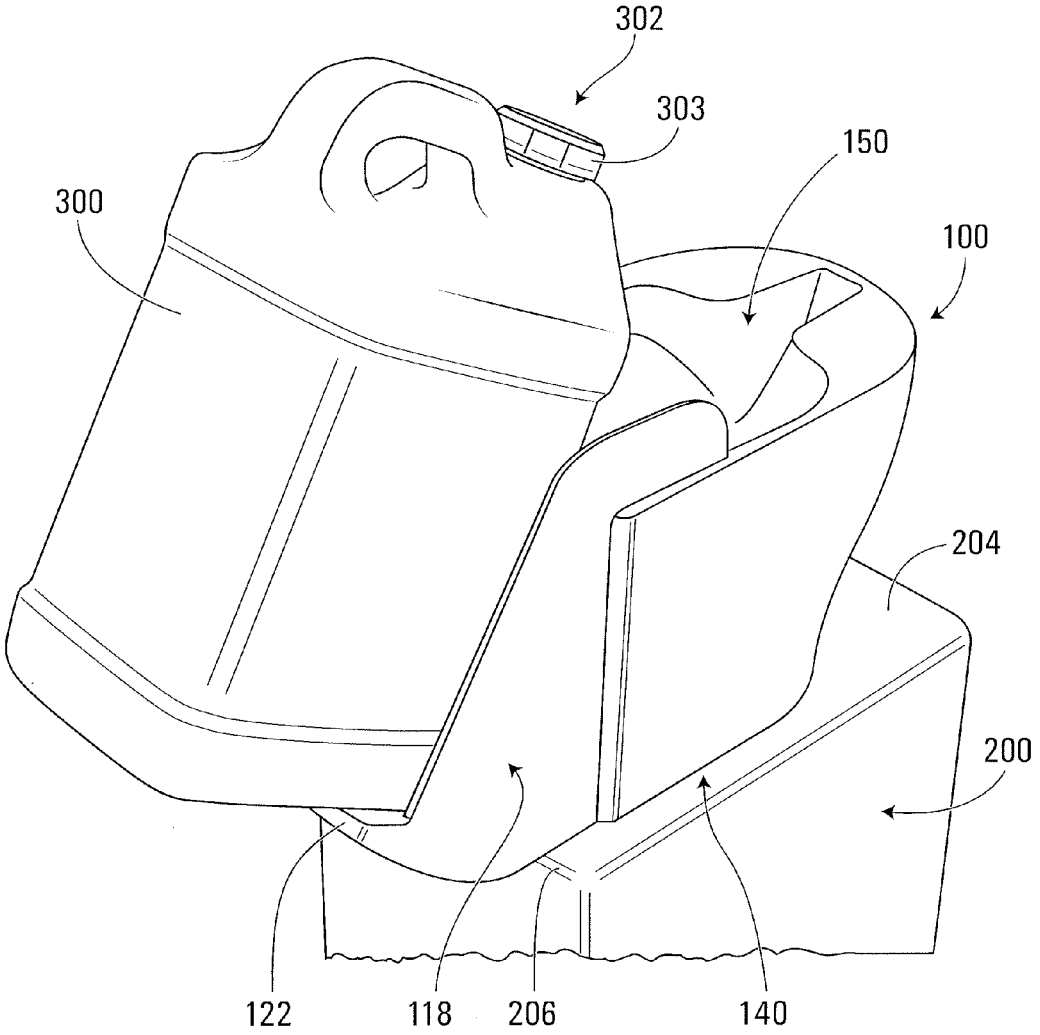
FIG. 7 is a perspective view of the funnel of FIG. 5 with a liquid container placed on a container shelf in preparation for emptying.

FIG. 7 shows a perspective view of the funnel 100 seated atop the tank 200 as in FIG. 6. In FIG. 7, a liquid-filled container 300 has been placed onto the container shelf 118, e.g. by a human technician, in preparation for emptying. A cap 303 shown in FIG. 7 may be removed from the container 300 by the human operator to access the opening 302 of the container, which is covered by a protective seal 308 in the present example.

Figure 8:
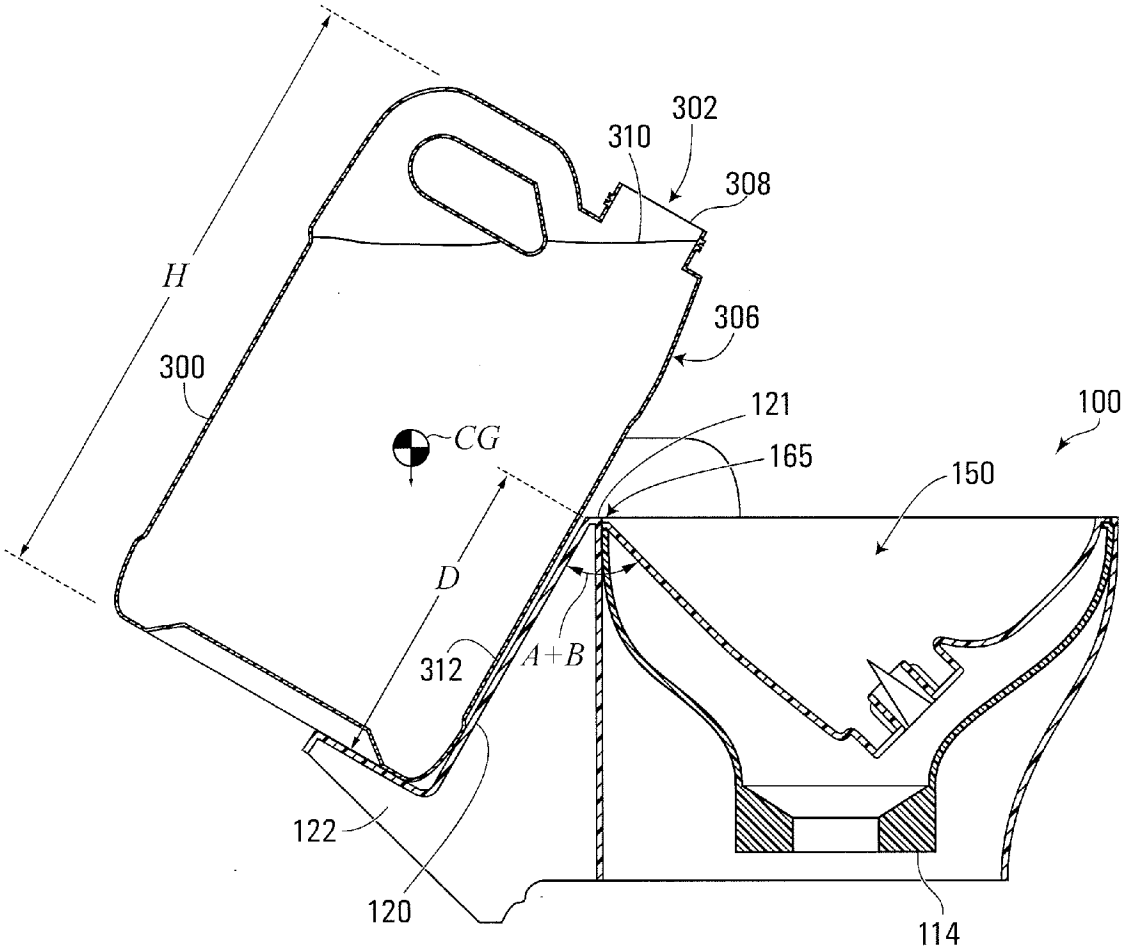
FIG. 8 is a cross-sectional view of the funnel and container of FIG. 7.

A cross-sectional view of the funnel 100 and container 200 of FIG. 7, omitting the fill tube 222 and tank 200, is provided in FIG. 8. In FIG. 8, the cap 303 has been removed to expose the opening 302 and protective seal 308.

As illustrated in FIGS. 7 and 8, the container shelf 118 supports the liquid-filled container 300 in an inclined position in which the container is inclined towards the receptacle 150. Referring to FIG. 8, it can be seen that the angle of incline A of the shelf 118 (here, 30 degrees) and the longitudinal extent D of the inclined wall 120 (which in the present embodiment may be considered as the distance between the foot 122 of the container shelf 118 and the upper edge 121 of the inclined wall 120) are such that an upper portion 306 of the container 300, and most of the opening 302, is positioned above the receptacle 150.

The angle of incline A is also such that a level of liquid 310 inside the container is below the opening 302 of the container 300 in the inclined position. In cases where the container opening 302 lacks a protective seal 308 or in which the seal 308 may be damaged, this may limit or prevent spillage of liquid from the opening 302 while the container 300 sits on the container shelf 118 in preparation for emptying. This may advantageously limit a risk of liquid contacting the skin of a human operator and/or may limit the need for safety gear such as gloves or a face mask for example.

It should be appreciated that, in some embodiments, the opening 302 of the liquid-filled container 300 may be partially or fully below the level of liquid 310 when the container 300 is in the inclined position on the shelf 118, if the angle of incline A of the container when sitting on the container shelf 118 were greater than what is shown in FIG. 8 for example. This may be considered acceptable in some embodiments, e.g. when there is a high degree of confidence that that the container opening 302 will be sealed with a protective seal 308 and that the seal 308 is likely to be undamaged, or when the liquid to be emptied is harmless (e.g. water).

Referring again to FIG. 8, it should be appreciated that the funnel 100 may be designed so that the center of gravity CG of the liquid-filled container 300 when sitting on the shelf 118 in the inclined position is slightly higher than the tipping edge 165 and on an opposite side of the tipping edge 165 from the receptacle 150. This may represent a compromise between two competing interests: stability of the container 300 on the shelf 118 in the inclined position prior to emptying, and ease of tipping of the container 300 from the inclined position to the declined position once emptying is to be commenced. Put another way, the tipping edge 165 of the funnel 100 may be slightly lower than, and closer to the receptacle from, an anticipated a center of gravity of the liquid-filled container 300 when in the inclined position on the shelf 118.

Alternatively, the funnel 100 may be designed so that the longitudinal extent D of the container shelf 118 is just over one half of a height H of whatever liquid-filled container is to be emptied using the funnel. Presuming that the profile of the container is fairly regular, that the container is mostly filled with liquid, and that the liquid is of uniform density, the weight distribution within the container may be sufficiently regular for such dimensioning of the shelf 118 to yield a similar compromise to what is discussed above.

Regardless of how D is determined, in FIG. 8 the inclined wall 120 contacts only a lower portion 312 of the proximate wall of the container 300.

Figure 9:
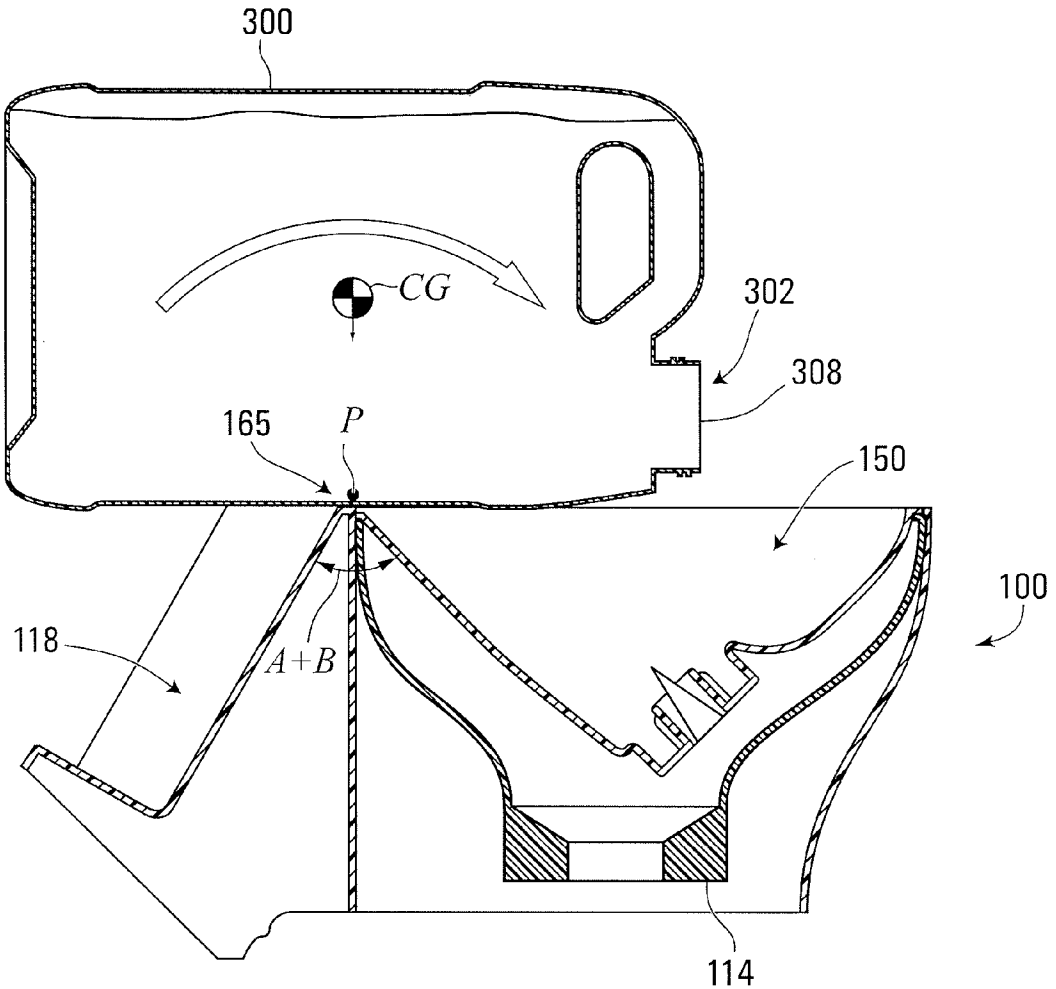
FIG. 9 is a cross-sectional view of the funnel and container of FIG. 7 with the container being tipped for emptying.

FIG. 9 provides a cross-sectional view of the funnel 100 and container 300 of FIG. 8 after tipping of the container has been commenced. As illustrated, the container 300 is tipped about the tipping edge 165, which acts as a fulcrum. Because tipping of the container 300 is commenced with the container 300 already in an inclined position, and because the liquid-filled container 300 need not be lifted but rather is tipped about the tipping edge 165 (at a point P on the side of the container), the amount of physical exertion involved in tipping the container 300 may be relatively low (e.g. perhaps requiring only a push by a human operator using one or two fingers in some embodiments). The guide extensions 130, 132 that flank the tipping edge 165 and part of receptacle 150 (see FIG. 1) may help to keep the container 300 from sliding laterally along the tipping edge 165 during tipping and afterwards.

Figure 10:
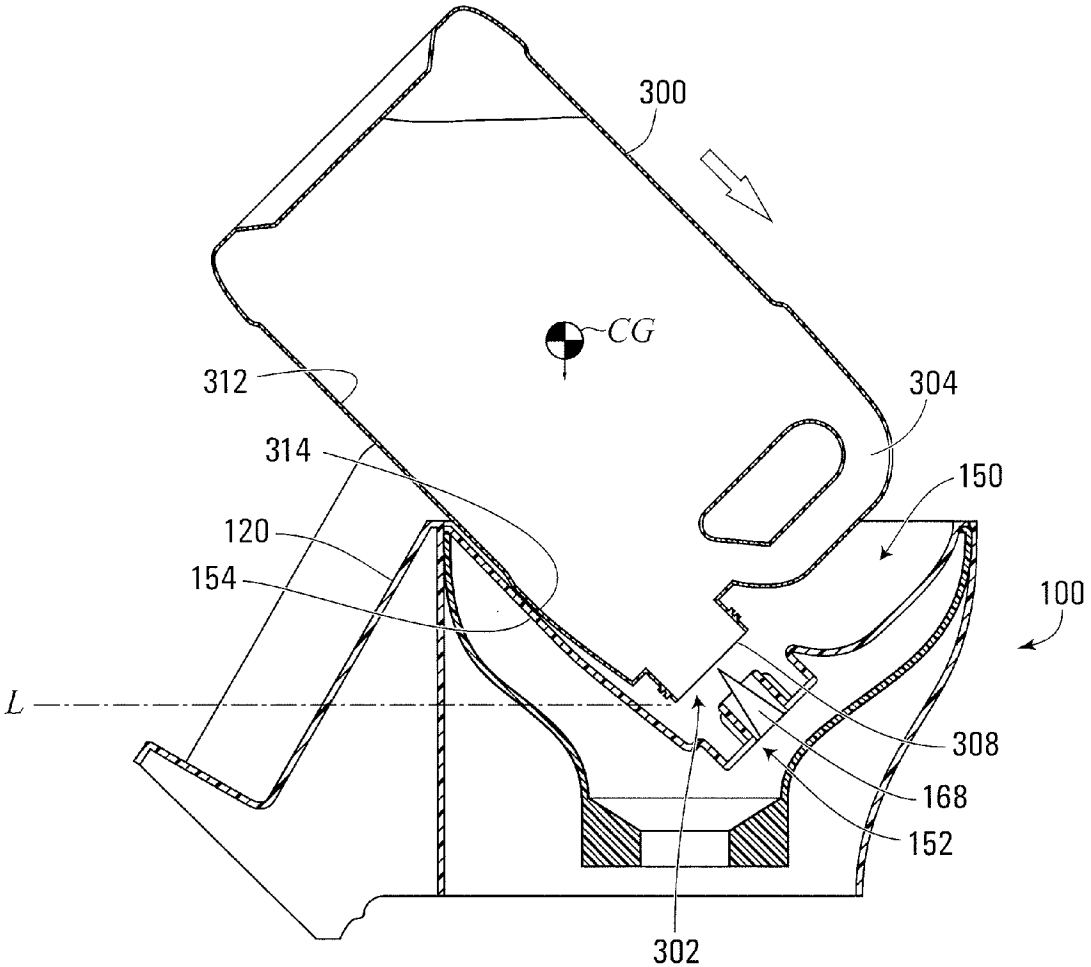
FIG. 10 is a cross-sectional view of the funnel and container of FIG. 7 with the container having been tipped over into a declined position but not yet fully seated within the funnel.
Figure 12:
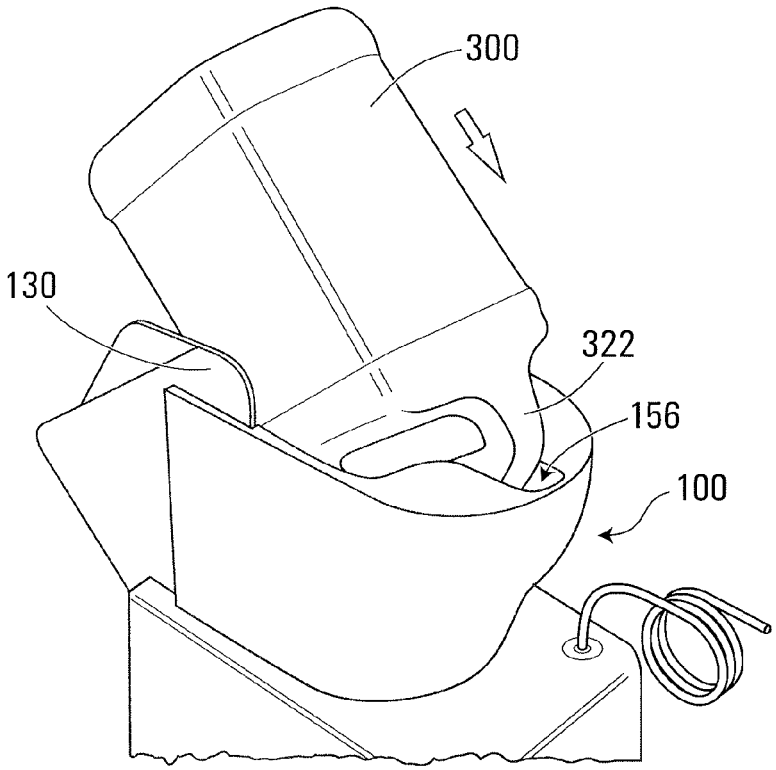
FIGS. 12 and 13 are perspective views of the funnel and container corresponding to the cross-sectional views of FIGS. 10 and 11 respectively.

FIG. 10 is a cross-sectional view of the funnel 100 and container 300 after the container 300 has been tipped over into a declined position but before the container 300 is fully seated within the receptacle 150. FIG. 12 shows the same stage of operation as FIG. 10 but in perspective view.

It will be appreciated that, at the stage of operation shown in FIGS. 10 and 12, the container 300 has been tipped through an angle of A+B degrees, where A is the angle of incline of the inclined wall 120 with respect to vertical and B is the angle of decline of the sloped wall 154 with respect to vertical (i.e. 30+45=75 degrees in this example—see FIG. 8). The amount of physical effort involved in tipping the container 300 through this angle may be less than what would be required to lower the container 300, in a fully inverted position, towards an upstanding piercing element.

Referring to FIG. 10, it can be seen that the lower portion 312 of the container wall that had previously been in contact with inclined wall 120 is now unsupported, while the previously unsupported upper portion 314 of the same container wall is now in contact with sloped wall 154. In the declined position of FIG. 10, the opening 302 of the container is at or near a lowermost point L of the container 300. This promotes complete or nearly complete emptying of the container 300. At this stage, the intact seal 308 prevents emptying from commencing and thereby continues to minimize or eliminate any risk of spillage of the liquid.

In view of the sealed opening 302, the container 300 should be fully seated within the receptacle 150 to commence emptying. This is shown in the cross-sectional and perspective views of FIGS. 11 and 13, respectively.

As illustrated, seating of the container 300 involves sliding the container, in the declined position, on the sloped wall 154 of the receptacle 150 towards the receptacle outlet 152. Sliding may be initiated by a human operator with the assistance of gravity or, in some cases, may be entirely gravity driven once the container 300 has been tipped. This may minimize the time and physical effort required of a human operator to commence emptying of the liquid, e.g. in comparison to approaches in which the container must be lifted or held.

Figure 11:
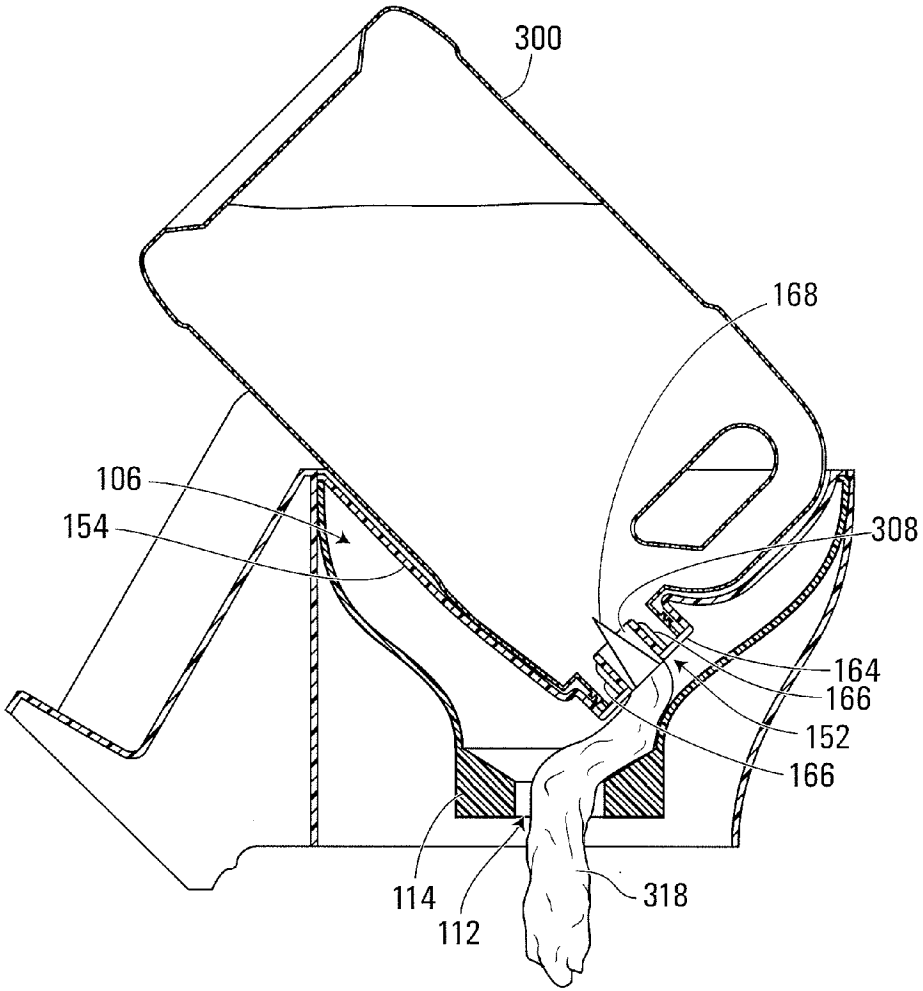
FIG. 11 is a cross-sectional view of the funnel and container of FIG. 7 with the container in the declined position and fully seated within the funnel.

Referring to FIG. 11, as the container 300 slides down sloped wall 154 at the angle of decline B, the seal 308 is driven into the piercing element 168, which is inclined upwardly towards the opening 302 at a complementary angle. As a result, the piercing element pierces the seal 308 substantially perpendicularly to the seal 308. When the now-pierced seal 308 is further driven, by the sliding motion, into the ring 164 and fins 166 (as originally shown in FIG. 2), the seal 308 is spread open. This allows liquid 318 to flow through the outlet 152, into the cavity 106, out of the funnel outlet 112, down the filling tube 222 and into the tank 200 (the latter two elements not being shown in FIG. 11; see FIG. 6). The fins 166 are received within the container opening 302 and may help to further spread the pierced seal 308. The fins 166 may also center the opening 302 with respect to the outlet 152 and engage the interior of the container opening 302 to help firmly seat the container 300 within the receptacle 150.

Figure 13:
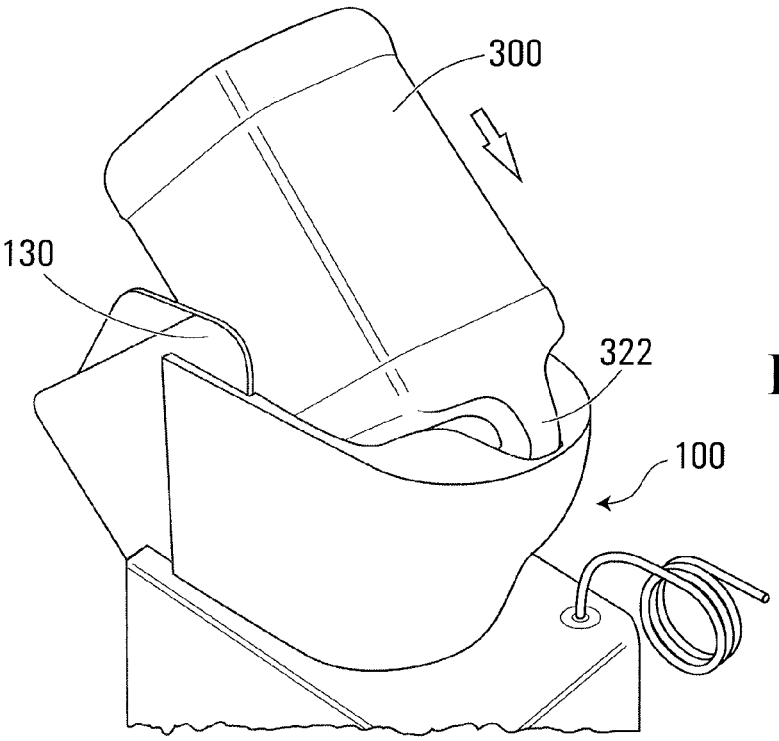

As the container 300 slides, the guide extensions 130, 132 that flank the container 300 and the handle guide 156 that receives the container handle 322 help to guide the liquid-filled container 300 into the fully seated position (see FIG. 12). The guide extensions 130, 132 flank the container 300 even after it has become fully seated, as shown in FIG. 13.

The container 300 may be left within the free-standing funnel 100 as it empties, possibly freeing a human operator to perform other work. After emptying, the container 300 may be left in place within the funnel 100 to act as a cover for the outlet 152, e.g. to limit ingress of contaminants into the outlet 152 or to limit evaporation of liquid, at least until a new liquid-filled container 300 requires emptying.

As should now be apparent, the illustrated funnel 100 may facilitate emptying of a liquid-filled container in various ways. The funnel 100 may avoid a need for a human operator to remove a protective seal on an opening of a liquid-filled container to be emptied, by operation of a piercing element to automatically pierce a protective seal, if present, largely by operation of gravity. The funnel 100 may minimize a risk of liquid splashing or spillage from a liquid-filled container having a protective seal by only piercing the seal upon full seating of the container into the funnel, which may be facilitated by centering features such as the handle guide 156. This may limit the need for safety equipment such as gloves or face protection. The funnel 100 may be used to empty liquid-filled containers regardless of whether their openings are sealed. The funnel 100 may limit the degree of physical effort required of a human operator, e.g. in comparison to approaches requiring a container to be lifted or held during inversion or emptying. This may in part by due to the fact that the liquid-filled container need not be fully inverted to be emptied. The funnel 100 may be adaptable for use with different containers by swapping out the insert 104 for another insert adapted for a different container. The funnel 100 may be free-standing and stable regardless of whether a liquid-filled container is sitting inclined on the shelf 118 or declined within the receptacle 150, possibly minimizing attention required of a human operator. The removable insert 104 of the funnel 100 may facilitate cleaning of the funnel. One or more of these possible benefits may equally apply to alternative embodiments of the funnel, depending upon the nature of the alternative embodiment.

It will be appreciated that the above-described embodiments are only examples and that various alternative embodiments may be effected within the scope of the claims that follow.

For example, it is not required for the funnel to be a two-piece unit including a base section and an insert. In some embodiments, the funnel may instead be a unitary component. In such embodiments, the outlet of the receptacle may constitute the outlet of the funnel, i.e. there may be only one outlet. In such embodiments, there may be no separate cavity for channeling liquid that has flowed out of a receptacle outlet to a separate funnel outlet, as in the embodiment described above.

Various ones of the features of the example funnel 100 could be omitted in some embodiments. These may include, without limitation, the shelf guides 124, 126, the guide extensions 130, 132, the handle guide 156, the wall 145 and the notches 136 and/or 138. The piercing element 168 could be omitted if the liquid-filled containers are known not to have any protective seals. In cases where the wall 145 is omitted, the ribs 134 may extend to and be connected with the exterior of the sloping wall of the cavity 106 and/or to the neck 114.

When a piercing element is present, it is not absolutely required for the piercing element to protrude from or be part of the receptacle outlet. For example, the piercing element could extend inwardly from a receptacle wall above a receptacle outlet. The piercing element may be tapered to facilitate piercing but is not necessarily tapered.

The ring 164 and/or the fins 166 could be varied, replaced or possibly omitted in some embodiments, provided that the protective seal is somehow sufficiently opened for egress of liquid, e.g. by suitable structure within the receptacle. More generally, the shape or size of the insert 104, the base section 102, the receptacle 150, the cavity 106, and the shelf 118 may differ, e.g. depending upon the nature of the containers to be emptied.

In the embodiment above, the tipping edge 165 is formed partly from the base section 102 (i.e. from rounded top edge 121 of the container shelf 118) and partly from the insert 104 (i.e. from a portion of the lip 157, between the rounded edge 121 and the receptacle 150). In alternative embodiments, the tipping edge could be a unitary component. The tipping edge need not be completely straight. In some embodiments, the tipping edge could be partially flat or could possibly even incorporate gaps, provided that the edge can still act as a fulcrum.

In the above-described embodiment, the funnel maintained in a stable position during use regardless of whether the liquid-filled container is in the inclined position on the container shelf or in the declined position within the receptacle. This is due in part to the engagement of the neck 114 with the tank opening 202. In some embodiments, the neck may not engage with the tank opening. In such case, the base of the funnel may be adapted to maintain the funnel as a free-standing, stable unit, e.g. by virtue of its wide footprint or by being shaped to conform to contours or features of a surface upon which the funnel is intended to be placed.

Although the above-described embodiment is specific to emptying an F-style container, alternative embodiments of the funnel could be used to facilitate emptying of other types of containers.

It will be appreciated that the term "emptying" as used herein does not necessarily mean "fully emptying." It can also mean "mostly emptying."

Other modifications may be made within the scope of the following claims.

What is claimed is:

1. A funnel for facilitating emptying of a liquid-filled container, the funnel comprising:

a receptacle configured to support the liquid-filled container in a declined position with an opening of the container at or near a lowermost point of the container, the receptacle having an outlet for liquid;

a container shelf adjacent to the receptacle, the container shelf configured to support the liquid-filled container in an inclined position in which the container is inclined towards the receptacle; and a tipping edge between the receptacle and a top of the container shelf, the tipping edge adapted to act as a fulcrum for tipping the container from the inclined position to the declined position.

2. The funnel of claim 1 further comprising a base adapted to support the funnel as a free-standing unit regardless of whether the liquid-filled container is in the inclined position on the container shelf or in the declined position within the receptacle.

3. The funnel of claim 1 further comprising a piercing element within the receptacle, the piercing element for piercing a protective seal covering an opening of the container upon sliding of the liquid-filled container, in the declined position, within the receptacle towards the outlet.

4. The funnel of claim 3 wherein the receptacle is adapted to support the liquid-filled container an angle of decline and wherein the piercing element protrudes inwardly and upwardly from the outlet at a complementary angle to the angle of decline.

5. The funnel of claim 4 wherein the outlet comprises a ring and a plurality of fins extending radially from the ring for spreading open the pierced protective seal.

6. The funnel of claim 1 wherein the container shelf is configured to support the liquid-filled container, in the inclined position, with the opening of the container at least partially over the receptacle.

7. The funnel of claim 1 wherein the container shelf is configured to support the liquid-filled container in the inclined position so that a level of liquid inside the inclined container is below the opening of the container.

8. The funnel of claim 1 wherein the container shelf comprises an inclined wall and a foot at a bottom of the inclined wall.

9. The funnel of claim 8 wherein a distance D between the foot and the top of the inclined wall is slightly more than one-half of a height of the container to be emptied.

10. The funnel of claim 8 wherein the inclined wall is inclined approximately 30 degrees from vertical.

11. The funnel of claim 8 wherein the inclined wall is flanked by container guides.

12. The funnel of claim 11 wherein the container guides also flank the tipping edge.

13. The funnel of claim 1 wherein the container shelf is configured to support the container in the inclined position with a center of gravity of the inclined liquid-filled container above a height of the tipping edge and on an opposite side of the tipping edge from the receptacle.

14. The funnel of claim 1 wherein the tipping edge is flanked by container guides.

15. The funnel of claim 1 wherein the receptacle is adapted to support the container in the declined position at an angle of decline of approximately 45 degrees.

16. The funnel of claim 1 wherein the receptacle comprises a sloped wall for slidably supporting the container, in the declined position, as the container becomes seated within the receptacle.

17. The funnel of claim 2 further comprising a spout in fluid communication with the outlet of the receptacle, the spout for discharging the liquid from the funnel, wherein the base is adapted for seating onto a liquid storage tank with the spout engaged with a tank opening.

18. The funnel of claim 17 wherein the base is notched to accommodate a top edge of a liquid storage tank into which the liquid-filled container is to be emptied, the notch for aligning the spout with the tank opening.

19. The funnel of claim 18 wherein the base is notched with multiple notches, each notch for accommodating a top edge of a different size of liquid storage tank for aligning the spout with the tank opening of the respective size of liquid storage tank.

20. The funnel of claim 17 wherein the spout, the base and the container shelf comprise a first component and wherein the receptacle comprises a second component that is removable from the first component.

21. The funnel of claim 20 wherein the tipping edge is formed from a top edge of the container shelf of the first component and from a portion of a lip of the second component, the portion of the lip being between the top edge of the container shelf and the receptacle when the first component is mated with the second component.

22. The funnel of claim 1 wherein the liquid-filled container is an F-style container.

23. A funnel for facilitating emptying of a liquid-filled container into a tank, the funnel comprising:

a receptacle configured to support the liquid-filled container in a declined position with an opening of the container at or near a lowermost point of the container, the receptacle having an outlet for liquid;

a container shelf adjacent to the receptacle, the container shelf configured to support the liquid-filled container in an inclined position in which the container is inclined towards the receptacle;

a tipping edge between the receptacle and a top of the container shelf, the tipping edge adapted to act as a fulcrum for tipping the container from the inclined position to the declined position;

a spout in fluid communication with the outlet of the receptacle, the spout for discharging the liquid from the funnel, the spout being adapted to engage a tank opening of the tank; and a base configured for placement on a surface of the tank, wherein the configuration of the base for placement on the surface of the tank and the adaptation of the spout for engagement of the tank opening collectively stabilize the funnel during use regardless of whether the liquid-filled container is in the inclined position on the container shelf or in the declined position within the receptacle.

24. A funnel for facilitating emptying of a liquid-filled container, the funnel comprising:

an insert comprising:

a receptacle configured to support the liquid-filled container in a declined position with an opening of the container at or near a lowermost point of the container, the receptacle having an outlet for liquid;

a base section comprising:

a cavity for removably receiving the insert;

a spout at the bottom of the cavity; and a container shelf adjacent to the cavity, the container shelf configured to support the liquid-filled container in an inclined position in which the container is inclined towards the cavity, wherein, when the insert is received within the cavity:

the outlet of the receptacle is in fluid communication with the spout; and either one or both of the insert and the base section define a tipping edge between the top of the container shelf and the receptacle, the tipping edge adapted to act as a fulcrum for tipping the container from the inclined position to the declined position.

25. The funnel of claim 24 wherein the insert further comprises a lip around at least a portion of the receptacle, the lip having an upper surface that is sloped downwardly towards the receptacle.

26. The funnel of claim 24 wherein the insert is a first insert, wherein the receptacle of the first insert is configured to support a first type of liquid-filled container in the declined position, and further comprising a second insert having a receptacle configured to support a second type of liquid-filled container in the declined position, the cavity of the base section being configured to removably receive the second insert in the alternative to the first insert.

* * * * *